US009463649B1

(12) United States Patent
Liu et al.

(10) Patent No.: US 9,463,649 B1
(45) **Date of Patent: *Oct. 11, 2016**

(54) INK AND MEDIA TREATMENT TO AFFECT INK SPREAD ON MEDIA IN AN INKJET PRINTER

(71) Applicant: Xerox Corporation, Norwalk, CT (US)

(72) Inventors: Chu-Heng Liu, Penfield, NY (US); Anthony S. Condello, Webster, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/866,131

(22) Filed: Sep. 25, 2015

(51) Int. Cl.
*B41J 11/00* (2006.01)
*B41J 2/01* (2006.01)

(52) U.S. Cl.
CPC ..... *B41J 11/0015* (2013.01); *B41J 2/01* (2013.01)

(58) Field of Classification Search
CPC .... B41J 3/543; B41J 11/0015; B41J 11/002; B41J 5/0011; B41J 5/0017; B41M 7/0081; B41M 7/009; C09D 11/30; C09D 11/101
USPC ..... 347/16, 17, 101, 102, 104
See application file for complete search history.

(56) References Cited

U.S. PATENT DOCUMENTS 5,287,123 A * 2/1994 Medin ..... B41J 11/002 347/102
5,784,090 A 7/1998 Selensky et al.
6,283,590 B1 * 9/2001 Peter ..... B41J 11/002 347/102
6,508,552 B1 1/2003 Steinfield et al.
6,786,589 B2 * 9/2004 Suzuki ..... B41J 11/002 347/101
7,080,900 B2 * 7/2006 Takabayashi ..... B41J 11/002 347/102
7,104,627 B2 9/2006 Weast
7,419,232 B2 * 9/2008 Hoshino ..... B41J 2/2132 347/102
7,530,684 B2 * 5/2009 Yamanobe ..... B41J 2/2114 347/100
7,682,014 B2 3/2010 Snyder et al.
7,758,157 B2 * 7/2010 Nagashima ..... B41J 2/2107 347/15
7,914,108 B2 * 3/2011 Konno ..... B41J 2/2114 347/100
8,215,744 B2 * 7/2012 Yamanobe ..... B41J 2/2114 347/21
8,297,729 B2 * 10/2012 Fujisawa ..... B41J 2/2114 347/102
8,376,542 B2 2/2013 Pedemonte et al.
9,073,357 B1 * 7/2015 Condello ..... B41J 2/01
2004/0196322 A1 * 10/2004 Nakajima ..... B41J 11/002 347/14
2011/0298876 A1 * 12/2011 Takeuchi ..... B41J 11/0015 347/102

FOREIGN PATENT DOCUMENTS

EP 1 306 223 A2 5/2003

* cited by examiner

*Primary Examiner* — Anh T. N. Vo
(74) *Attorney, Agent, or Firm* — Maginot Moore & Beck LLP

(57) ABSTRACT

A printer comprises a plurality of printheads, at least one auxiliary dryer positioned immediately adjacent the plurality of printheads and configured to control spread of ink drops ejected by the plurality of printheads, a main dryer positioned to dry ink on the media after the media has passed the at least one auxiliary dryer, at least one actuator to drive media transport and move media past each of these components, and a controller. The power of the main dryer is higher than the power of the auxiliary dryer. The controller is operatively connected to each of the components and is configured to control the operation of the at least one auxiliary dryer with reference to the type of media being printed and the type of ink being ejected. A method for operating the printer is also disclosed.

6 Claims, 5 Drawing Sheets

INK AND MEDIA TREATMENT TO AFFECT INK SPREAD ON MEDIA IN AN INKJET PRINTER

TECHNICAL FIELD

This disclosure relates generally to inkjet printers, and, in particular, to systems and methods for affecting ink drop spread in inkjet printers.

BACKGROUND

Inkjet printing machines or printers include at least one printhead that ejects drops of liquid ink onto the surface of media. An inkjet printer employs inks in which pigments or other colorants are suspended in a carrier or are in solution with a solvent. The solvent may be water based, as in aqueous inks, or non-water based, as in non-aqueous inks. The amount of spread of ink drops ejected onto media affects the quality of the ink image formed. The spread of aqueous ink drops can be large enough to affect image quality adversely, particularly on coated media, such as papers having glossy, semi-glossy, or matte surfaces. These coated media are sometimes called offset paper and the interaction of aqueous ink with the surface of offset paper can be problematic. For example, aqueous ink ejected onto offset papers having glossy or semi-glossy surfaces often does not penetrate the media or get absorbed properly. The glossy or semi-glossy surfaces are water resistant because the surfaces have a relatively low porosity or permeability compared to uncoated papers. Consequently, the individual ink drops, which dry primarily by evaporation of water in the ink, slowly spread laterally across the surface of the coating before drying. If the drops are not dry enough and, consequently, are too mobile after they have joined with adjacent drops, a possibility exists of disturbing or moving the ink in these areas so the basic positions of these drops, the uniformity of the thickness of the inks at various positions, or both are affected. These conditions are commonly known as "coalescing" and "puddling" of the ink drops and noticeably impacts print quality. Because coalesced or puddled ink drops exhibit uneven thicknesses and drying characteristics they may also be undesirably transferred to other surfaces with which the media comes into contact, such as other paper in a sheet fed printing process. Moreover, when inks dry too slowly, two different colors of ink ejected adjacent each other tend to bleed into one another producing a defect known as "intercolor bleed."

Another example of the interaction of aqueous ink with offset papers occurs with offset papers having a matte finish. This type of surface often absorbs too deeply into the paper. The matte surfaces are more porous than glossy paper, allowing for deeper penetration of ink, especially aqueous ink due to high water content. Accordingly, the printed image may lose color richness. Localized differences in the water content of media can also result in undesirable paper cockle. Thus, a system or method that reduces the spread of ejected ink drops in inkjet printers is desirable.

SUMMARY

A printer that improves ink spread over previously known printers includes a plurality of printheads, each printhead in the plurality of printheads having a plurality of ejectors configured to eject ink, at least one auxiliary dryer positioned adjacent the plurality of printheads to enable the at least one auxiliary dryer to control spread of ink drops ejected onto the media by the printheads, at least one main dryer configured to dry ink ejected by the plurality of printheads, the at least one main dryer having a higher power rating than the at least one auxiliary dryer, at least one actuator to drive media transport and move media past the plurality of printheads, the at least one auxiliary dryer, and the at least one main dryer, and a controller operatively connected to the at least one actuator, the plurality of printheads, the at least one auxiliary dryer, and the at least one main dryer. The controller is configured to operate the at least one actuator to move the media past the plurality of printheads, the at least one auxiliary dryer, and the at least one main dryer, to operate the plurality of ejectors in the plurality of printheads to eject ink onto the media to form an ink image on the media, to operate the at least one auxiliary dryer to control spread of the ink drops ejected by the plurality of printheads, and to operate the at least one main dryer to dry ink ejected by the plurality of printheads after the spread of the ink drops on the media has been controlled.

A method of operating a printer that improves ink spread over previously known printers includes operating with a controller at least one actuator to drive a media transport and move media past a plurality of printheads, each printhead having a plurality of ejectors, past at least one auxiliary dryer positioned adjacent the plurality of printheads, and past at least one main dryer configured to dry ink ejected by the plurality of printheads, the at least one main dryer having a higher power rating than the at least one auxiliary dryer, operating with the controller the plurality of printheads to eject ink from the plurality of ejectors to a surface of media to form an ink image on the surface of the media, operating with the controller the at least one auxiliary dryer to control spread of ink drops on the media, and operating with the controller the at least one main dryer to dry the ink ejected by the plurality of printheads after the media has past the at least one auxiliary dryer.

BRIEF DESCRIPTION OF THE DRAWINGS

The foregoing aspects and other features of a printing system are explained in the following description, taken in connection with the accompanying drawings.

DETAILED DESCRIPTION

Figure 1A:
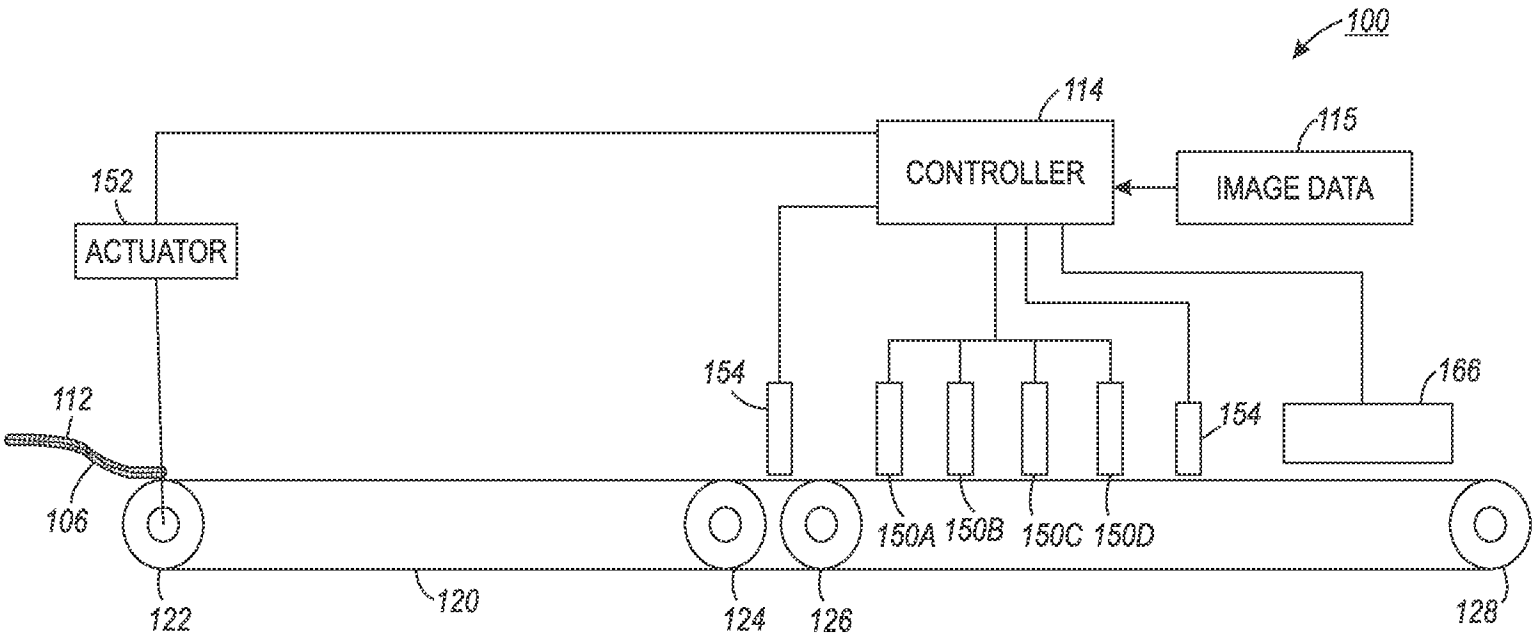
FIG. 1A is a schematic drawing of an inkjet printer with a pair of auxiliary dryers that help regulate ink drop spread.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, direct to object label press, or the like, which generates printed images for any purpose. "Image data" refers to information in electronic form that are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water relative to the amount of colorant and solvent in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are staggered in diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction in the plane of the media. "Process direction" refers to the direction in which the image receiving surface is moving. As used in this document, the term "aqueous ink" includes liquid inks in which colorant is in a solution, suspension or dispersion with a liquid solvent that includes water and one or more liquid solvents. The terms "liquid solvent" or more simply "solvent" are used broadly to include liquids that dissolve colorants into a solution or that hold particles of colorant in a suspension or dispersion without dissolving the colorant.

As used in this document, the term "dryer" refers to a device that generates airflow, energy, or both. The generated energy can be heat or curing radiation. Generated heat can include radiant, convective, conductive, or a combination of these types of heat. Curing radiation is ultraviolet radiation useful for curing liquid photopolymer. A dryer can produce an amount of heat that alters the temperature of the media or object passing the dryer, or a dryer can produce an amount of heat that maintains the media or object at a predetermined temperature.

FIG. 1A illustrates a high-speed aqueous ink image producing machine or printer 100 with features that aid in limiting ink spread and reduce or eliminate excessive coalescence and puddling of printed ink on offset style coated papers and uncoated papers. As illustrated, the printer 100 is of the type that ejects ink drops directly on a surface of media 106, which may be offset style coated paper media, or uncoated paper media, and includes a mechanical decurler 112, an electronic subsystem (ESS) or controller 114, an endless belt 120 with rollers 122, 124, 126, 128, one or more actuators 152, a plurality of printhead modules 150A-150D, auxiliary dryers 154, and a main dryer 166.

Controller 114 is operatively connected to actuators 152, printhead modules 150A-150D, auxiliary dryers 154, and main dryer 166. Controller 114 is, for example, a self-contained, dedicated computer having a central processor unit (CPU) with electronic storage, and a display or user interface (UI). Controller 114 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

The controller 114 generates electrical signals to operate one and possibly more actuators 152 to drive a media transport having one or more rollers 122, 124, 126, 128 entrained about the endless belt 120 to move the endless belt about the rollers. The endless belt 120 moves media 106 past printhead modules 150A-150D, the auxiliary dryers 154, and the main dryer 166. While the media transport is depicted with an endless belt 120 to transport media sheets, the actuators 152 can be configured to drive a series of rollers, with or without an endless belt, to transport a continuous web of media. Controller 114 is also configured to receive image data from an image data source 115, such as a scanner or application program. The controller 114 renders the image data and generates firing signals that are used to operate inkjet ejectors in the printheads of the modules 150A-150D to eject ink onto media passing by the printheads. Although the printer 100 includes four printhead modules 150A-150D, each of which has two arrays of printheads, alternative configurations can include a different number of printhead modules or arrays within a module.

Figure 1B:
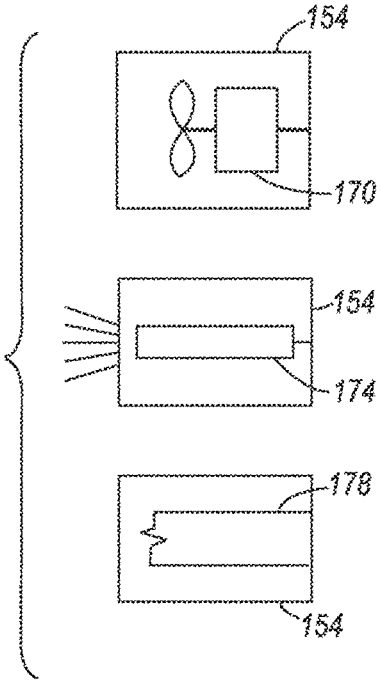
FIG. 1B depicts various embodiments of the auxiliary dryers.

The controller 114 further operates one or both of the auxiliary dryers 154 and the main dryer 166 to dry ink ejected onto the media by the printheads in a manner described in more detail below. As shown in FIG. 1B, auxiliary dryers 154 and main fan 166 can be configured with a fan 170 to direct a cooling fluid, such as air, towards the surface of media 106, a radiator 174 configured to direct electromagnetic radiation towards media 106, or a radiant heating element 178, such as an electrical resistance heating element, configured to direct heat towards paper, or any other known type of dryer. Additionally, the auxiliary dryers 154 can be positioned and oriented to treat the side of the media that is opposite the side shown in FIG. 1A. That is, the auxiliary heaters 154 can be positioned beneath the media 106 to dry, heat, or both dry and heat the media on the side of the media that is not printed by the printheads 150A-150D.

In the embodiment shown, main dryer 166 is configured to dry ink images formed on the surface of media 106 fully. Main dryer 166 is positioned near, but not immediately adjacent to, printhead modules 150A-150D. As in previously known inkjet printers, the main dryer 166 of printer 100 has a relatively large size that prohibits placement of the main dryer directly adjacent the printhead modules 150A-150D because the heat and air flow produced by the dryer 166 can adversely impact the printing of the image on the media beneath the printheads. Auxiliary dryers 154, however, are positioned immediately adjacent each side of the printhead modules 150A-150D. Auxiliary dryers 154 have a lower power rating and a smaller size relative to dryer 160, which enables the auxiliary dryers to be placed closer to the printhead modules 150A than the main dryer 166 without disrupting the printing of the ink image on the media. The first auxiliary dryer 154 can be operated to raise the media to a temperature that helps control or eliminate ink drop spread by affecting the temperature, the dryness, or both the temperature and dryness of the media. The second auxiliary dryer 154 can be operated to help partially fix ink drops on the media to help control or eliminate ink drop spread. The controller 114 adjusts the electrical power delivered to the dryers 154 to regulate ink drop spread before the ink image on the media reaches the main dryer 166.

In operation of printer 100, media 106 is retrieved from media storage (not shown) and fed through mechanical de-curler 112 before reaching belt 120. Mechanical de-curler 112 is configured with an S-shaped bend path, as shown in FIG. 1A, to help attenuate any irregularities the media may have from its loading into the printer or its storage in the printer. The configuration of the de-curler 112 is particularly effective to reduce irregularities of the media in the cross process direction of media 106. Sheet irregularities include folds, creases, wrinkles, or any other curl present in the media caused by media mishandling and other environmental factors, such as humidity. Preexisting sheet input curl can be especially prevalent when cut-sheet media is used and the sheets are coated on one side only. In one embodiment, the curves in the S-shaped bend are symmetrical and have radii of between 5 to 20 mm (depending on the stiffness of substrate), which are useful to address sheet input curl in the first 3 to 5 inches of the media. The radii are at the lower end of this range for lower weights of media and at the higher end of the range for heavier weights of media. In other embodiments, another known type of de-curler is used, while in yet other embodiments no de-curler is implemented in printer 100. In other embodiments the media 112 can be a continuous feed type.

After the media 106 exits the de-curler 112, it travels on endless belt to a position opposite the first auxiliary dryer 154. Controller 114 can operate the first dryer 154 to raise the media to a predetermined temperature that prepares the media surface for reception of ink drops. The controller 114 is configured to operate the first auxiliary dryer 154 with reference to the type of media to be printed. Some media types require no heat treatment, while others need to be raised to different temperatures to help address ink drop spread on the media. Additionally, the controller 114 is also configured to operate the first auxiliary dryer 154 with reference to the type of ink being ejected by the printhead modules 150A-150D. For example, some media types need to be raised to higher temperatures to reduce ink drop spread for aqueous inks than the temperatures needed to regulate ink drop spread for ink emulsions. After the media has passed the first auxiliary dryer 154, it passes beneath the printhead modules 150A-150D as controller 114 generates firing signals with reference to the image data from image data source 115 and sends the signals to printhead modules 150A-150D to operate the ejectors in the printheads and eject ink onto media 106 to form an ink image. Immediately after passing by printhead modules 150A-150D, the media 106 passes under the second auxiliary dryer 154. Controller 114 can operate the second dryer 154 to heat treat the media and the ink drops on the media to control the spread of the ink drops on the media. This heat treatment can evaporate water from the ink, change the viscosity of the ink, or aid in adjusting the dryness of the media. Again, the controller 114 is configured to operate the second auxiliary dryer 154 with reference to the type of media to be printed and the type of ink being ejected by the printhead modules 150A-150D. The operation of the second auxiliary dryer 154 partially dries the ink image formed on the surface of media 106 to control the spread of the ink drops on the surface of media 106. After media 106 passes by the second auxiliary dryer 154, media 106 passes under main dryer 166 so main dryer 166 can fully dry the ink image stabilized on the media surface by the operation of one or both auxiliary dryers 154.

The positioning of the first auxiliary dryer 154 immediately adjacent the printhead module 150A enables the media to reach and maintain a temperature useful for drying the media so it is better prepared to receive the type of ink being ejected by the printheads. The second auxiliary dryer 154 is positioned so the time between ink ejection by the printhead ejectors and drying of the ink drops and media by the second auxiliary dryer is reduced compared to the time between ink ejection and drying in previously known printers having only a main dryer since the time between ink ejection and drying has been found to affect the spread of ink in some cases. For example, in these cases enabling too much time to occur between ink ejection and drying causes the ink to spread too much and cause image quality defects such as coalescence, puddling, excessive line widths, and ragged line edges. As stated earlier, the printers having a main dryer could not be positioned to aid effectively in reducing ink drop spread since the main dryer has physical dimensions that prohibit the main dryer from being positioned directly adjacent the printhead modules. Accordingly, auxiliary dryers 154 of printer 100 reduce the undesired spread of aqueous ink on coated papers. Because auxiliary dryers 154 do not fully dry the ink image, printer 100 still includes the main dryer 166 to dry the ink image fully. Another reason for positioning these auxiliary heaters as described relates to the difference between the distance and time between the ink drops ejected by the first printhead reaching the main dryer and the ink drops ejected by the last printhead reaching the main dryer. This difference in time and distance requires compensation on a color to color basis. An additional reason for the positions of the auxiliary dryers is the differences in ink chemistry between different colors may require compensation as well.

Figure 2:
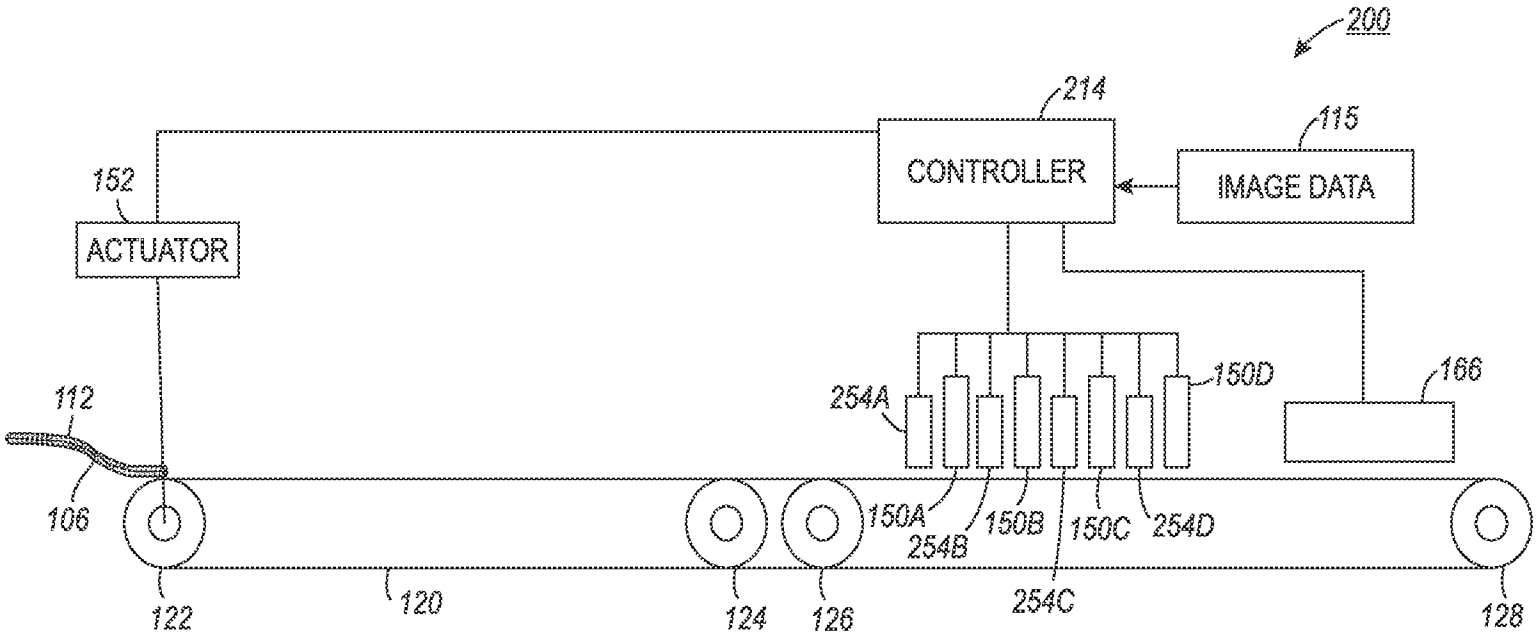
FIG. 2 is a schematic drawing of another inkjet printer with a plurality of auxiliary dryers interspersed between printheads in the printer to control ink drop spread.

FIG. 2 illustrates a high-speed aqueous ink image producing machine or printer 200 with features that aid in ink spread and reduce or eliminate excessive coalescence and puddling of printed ink on offset style coated papers and uncoated papers. As illustrated, the printer 200 is substantially similar to the printer 100 of FIG. 1A, where like numbers correspond to like parts, including a mechanical decurler 112, an endless belt 120 with rollers 122, 124, 126, 128, one or more actuators 152, a plurality of printhead modules 150A-150D, and a main dryer 166. Printer 200 further includes a plurality of auxiliary dryers 254A-254D, and an electronic subsystem (ESS) or controller 214 operatively connected to the actuators 152, printhead modules 150A-150D, auxiliary dryers 254A-254D, and main dryer 166.

The auxiliary dryers 254A-254D and printhead modules 150A-150D are placed in alternating order such that at least one of the auxiliary dryers is positioned between two adjacent printhead modules as shown in FIG. 2. The embodiment of printer 200 shown in FIG. 2 includes four auxiliary dryers. In other embodiments, one, two, three, five, six or any desired number of auxiliary dryers may be incorporated. Similar to auxiliary dryer 154 of printer 100, dryers 254A-254D have a lower power rating and a size relatively smaller than dryer 166, which enables placement of the auxiliary dryers between and close to the printhead modules 150A-150D. The power of the auxiliary dryers 254A-254D are individually adjustable by controller 214 with reference to media and ink type to achieve a desired amount of drying.

In operation of printer 200, media 106 is retrieved from media storage (not shown) and fed through mechanical de-curler 112 before reaching belt 120. After passing through mechanical de-curler 112, media 106 then travels on endless belt 120 beneath printhead modules 150A-150D and auxiliary dryers 254A-254D so the printheads in the modules can eject ink drops onto the media with reference to image data from image data source 115 and the auxiliary dryers 254A-254D can dry ink ejected by the printheads in the modules. Controller 214 is configured to control the auxiliary dryers 254A-254D independently to enable the drying of ink drops immediately after ejection of ink from each individual printhead module. When each printhead module utilizes a different color, for example, the independently controllable auxiliary dryers provide for individual drying of each color to prevent individual colors from spreading. After media 106 passes by the auxiliary dryers 254A-254D, media 106 passes under main dryer 166, which completes the drying of the ink image.

Figure 3:
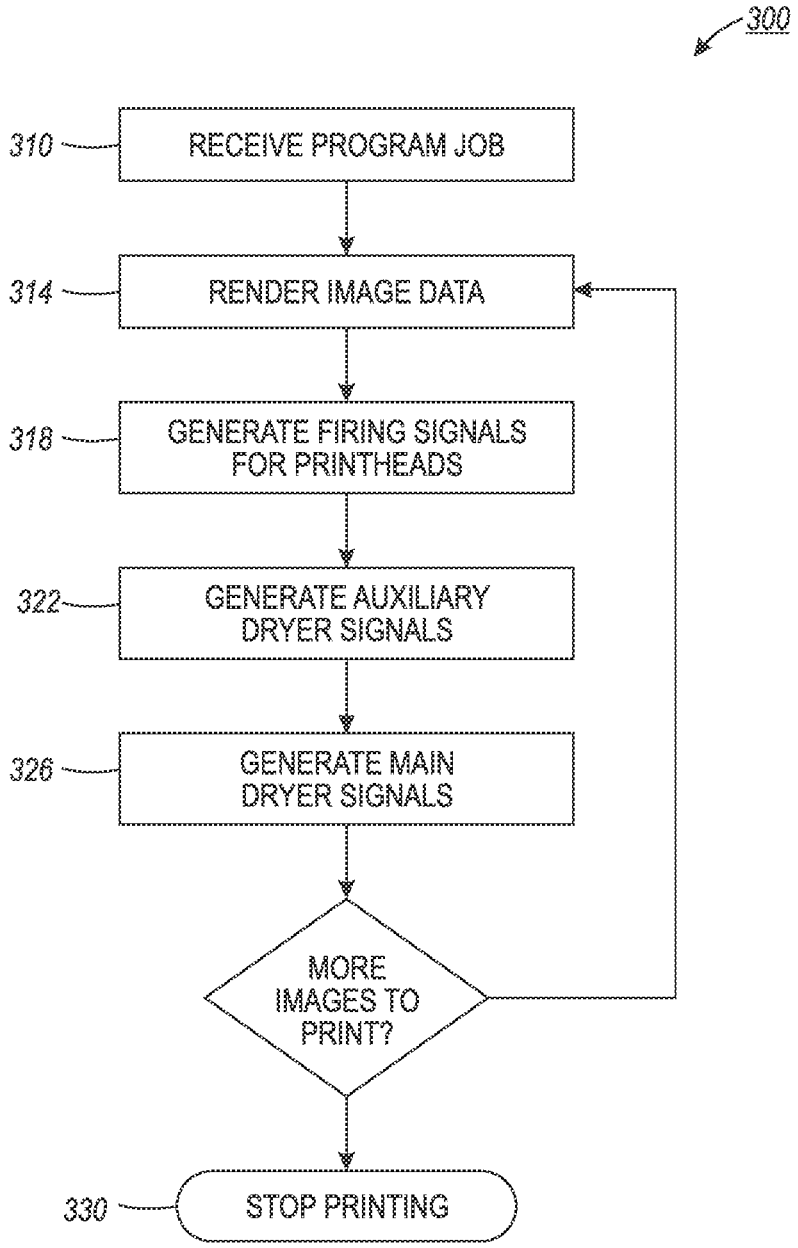
FIG. 3 is a flow diagram of a process for operating the inkjet printer of FIG. 1A.
Figure 4:
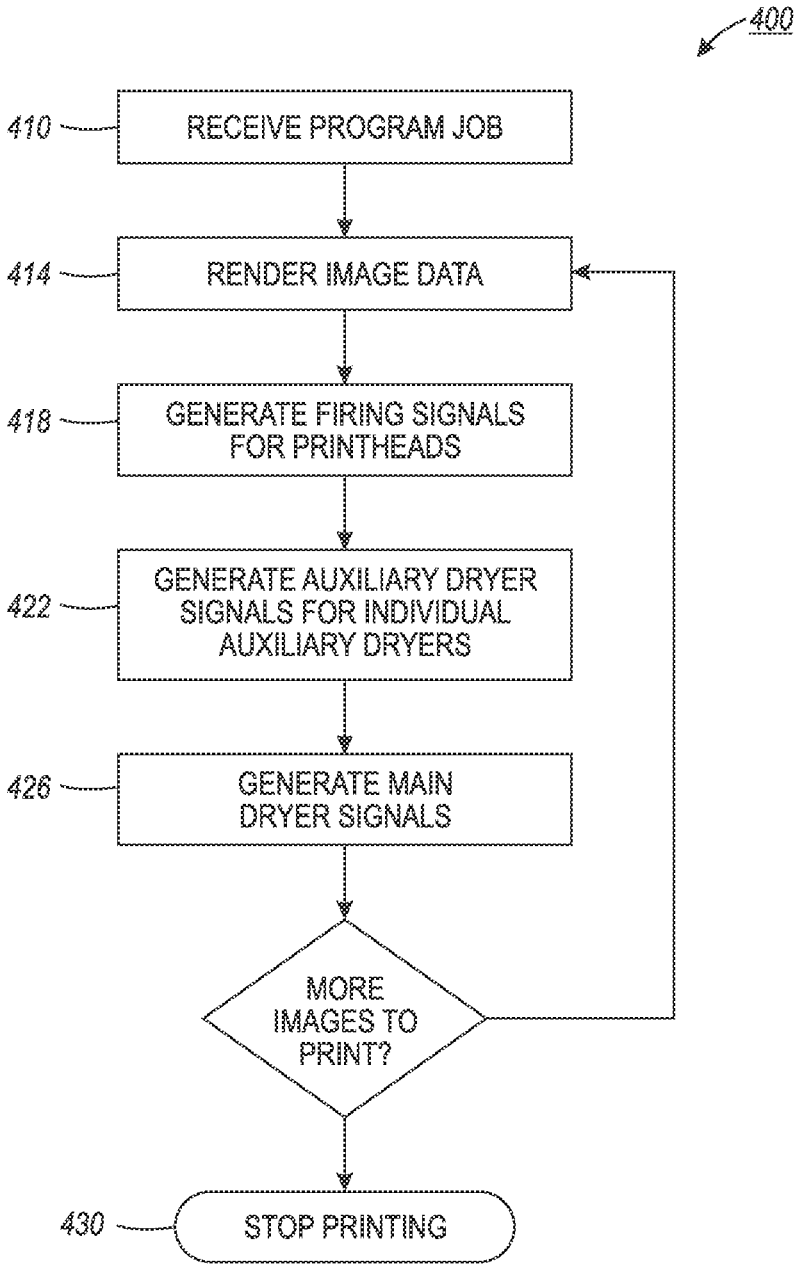
FIG. 4 is a flow diagram of a process for operating the inkjet printer of FIG. 2.

FIG. 3 depicts a process 300 for operating a printer, such as printer 100 of FIG. 1A, having a pair of auxiliary dryers that reduce ink drop spread. FIG. 4 depicts a process 400 for operating a printer, such as printer 200 of FIG. 2, which uses auxiliary dryers dispersed through the printheads to reduce ink drop spread. In the following description of these processes, statements that a process is performing some task or function refers to a controller or general purpose processor executing programmed instructions stored in a memory operatively connected to the controller or processor to manipulate data or to operate one or more components in the printer to perform the task or function. The controllers 114, 214 noted above can be such a controller or processor. Alternatively, controllers 114, 214 can be implemented with more than one processor and associated circuitry and components, each of which is configured to form one or more tasks or functions described herein.

According to process 300 of FIG. 3, upon receipt of a printing job (block 310), process 300 receives data of image content to be printed. These data are rendered (block 314) to enable the process to generate firing signals for the printheads (block 318). The process then sends signals to the auxiliary dryers 154 to activate the dryers to heat treat the media prior to printing and to dry the ink image formed on the media immediately after it is printed (block 322). Controller 114 also sends signals to the main dryer 166 to activate the dryer to dry the ink image fully (block 326). If more image data are to be printed, the process continues process with the rendering of additional data (block 314). Otherwise, the printing operation ends (block 330).

According to process 400 of FIG. 4, upon receipt of a printing job (block 410), process 400 receives data of image content to be printed. These data are rendered (block 414) to enable the process to generate firing signals for the printheads (block 418). The process simultaneously sends signals to the auxiliary dryers 254A-254D to activate dryers associated with printheads that ejected ink onto the media to dry partially the ink image formed on the media (block 422) and to send signals to the main dryer 166 to activate the dryer to dry the ink image fully (block 426). If more image data are to be printed, the process continues with the rendering of additional data (block 414). Otherwise, the printing operation ends (block 430).

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a plurality of printheads, each printhead in the plurality of printheads having a plurality of ejectors configured to eject ink;

a plurality of auxiliary dryers, each auxiliary dryer in the plurality of auxiliary dryers being positioned between a different pair of adjacent printheads in the plurality of printheads, each auxiliary dryer being configured as a fan to direct a fluid towards a surface of media onto which the plurality of printheads eject ink to at least partially dry ink ejected by the plurality of printheads and enable the plurality of auxiliary dryers to control spread of ink drops ejected onto the media by the printheads;

at least one main dryer configured to dry ink ejected by the plurality of printheads, the at least one main dryer being positioned to dry ink after the media has past the plurality of printheads and the plurality of auxiliary heaters, and the at least one main dryer having a higher power rating than each auxiliary dryer in the plurality of auxiliary dryers;

at least one actuator to drive media transport and move media past the plurality of printheads, the plurality of auxiliary dryers, and the at least one main dryer; and a controller operatively connected to the at least one actuator, the plurality of printheads, the plurality of auxiliary dryers, and the at least one main dryer, the controller being configured to operate the at least one actuator to move the media past the plurality of printheads, the plurality of auxiliary dryers, and the at least one main dryer, to operate the plurality of ejectors in the plurality of printheads to eject ink onto the media to form an ink image on the media, to operate each auxiliary dryer in the plurality of auxiliary dryers independently of one another and with reference to a type of media being printed and a type of ink being elected by the printheads to control spread of the ink drops ejected by the plurality of printheads onto the media, and to operate the at least one main dryer to dry ink ejected by the plurality of printheads after the spread of the ink drops on the media has been controlled.

2. The printer of claim 1, the plurality of auxiliary dryers including another auxiliary dryer positioned between the plurality of printheads and the at least one main dryer, the other auxiliary dryer being configured to at least partially dry ink drops ejected by the plurality of printheads after the ink drops have been ejected to the media to control spread of ink drops on the media.

3. The printer of claim 2, the plurality of auxiliary dryers including another auxiliary dryer being positioned adjacent a first printhead of the plurality of printheads in a direction in which the media moves, the other auxiliary dryer positioned adjacent the first printhead being configured to heat the media before ink drops are ejected onto the media by the plurality of printheads to prepare the media and control spread of the ink drops on the media.

4. A method of operating a printer comprising:

operating with a controller at least one actuator to drive a media transport and move media past a plurality of printheads, each printhead having a plurality of ejectors, past a plurality of auxiliary dryers, and past at least one main dryer configured to dry ink ejected by the plurality of printheads, the at least one main dryer having a higher power rating than each auxiliary dryer in the plurality of auxiliary dryers;

operating with the controller the plurality of printheads to eject ink from the plurality of ejectors to a surface of media to form an ink image on the surface of the media;

operating with the controller each auxiliary dryer in the plurality of auxiliary dryers independently of one another and with reference to a type of media being printed and a type of ink being ejected by the printheads to at least partially dry the ink ejected by the plurality of printheads and control spread of ink drops on the media, each auxiliary dryer in the plurality of auxiliary dryers being a fan that directs fluid towards the media passing by the printheads and each fan being positioned between different pairs of adjacent printheads in the plurality of printheads; and operating with the controller the at least one main dryer to dry the ink ejected by the plurality of printheads after the media has past the at least one auxiliary dryer.

5. The method of claim 4 further comprising:

operating with the controller another auxiliary dryer positioned between the main dryer and the plurality of printheads to at least partially dry ink ejected by the plurality of ejectors after the ink drops have been ejected onto the media, the other auxiliary dryer positioned between the main dryer and the plurality of printheads being a fan.

6. The method of claim 5 further comprising:

operating with the controller another auxiliary dryer positioned adjacent a first printhead of the plurality of printheads in a direction of the media movement to heat the media before ink drops are ejected onto the media by the plurality of printheads to control spread of the ink drops on the media, the other auxiliary dryer positioned adjacent the first printhead being a fan.

* * * * *